United States Patent [19]

Vass et al.

[11] 4,003,291

[45] Jan. 18, 1977

[54] MISSILE LAUNCHING MINE

[75] Inventors: Oscar R. Vass, Adelphi, Md.; Leslie C. Taylor, Washington, D.C.; Charles A. Lewis, Silver Spring, Md.

[73] Assignee: The United States of America as represented by the Secretary of the Navy, Washington, D.C.

[22] Filed: May 20, 1964

[21] Appl. No.: 369,034

[52] U.S. Cl. ..... 89/1.810; 102/12; 102/13

[51] Int. Cl.[2] ..... F41F 3/10

[58] Field of Search ..... 89/1, 1.7, 5, 1.92; 102/3, 4, 7, 10–14, 16

[56] References Cited

UNITED STATES PATENTS

| | | | |
|---|---|---|---|
| 467,792 | 1/1892 | Elliott | 102/16 |
| 1,394,083 | 10/1921 | Griffiths | 89/1 L X |
| 1,707,112 | 3/1929 | Browne | 102/17 |
| 2,349,009 | 5/1944 | Schwab | 102/10 X |
| 2,949,853 | 8/1960 | Vogt | 102/10 |
| 3,137,203 | 6/1964 | Brown | 89/1.810 |
| 3,158,062 | 11/1964 | Feiler | 89/1.810 |

OTHER PUBLICATIONS

Missiles and Rockets, Jan. 1957, pp. 18–19, "Break-up in Army-Navy Jupiter Program", Erik Bergaust.

*Primary Examiner*—David H. Brown

EXEMPLARY CLAIM

2. An underwater multiple missile launcher comprising a platform, a plurality of missile launching tubes disposed at acute angles to a normal to the surface of said platform whereby missiles launched from said tubes will be launched along divergent paths which define a predetermined pattern, said tubes mounted for limited pivotal movement on said platform for compact storage in parallel positions and for movement to the acute angle positions upon deployment of the launcher, an initially collapsed inflatable bag secured to said platform between said tubes for pivoting said tubes to their acute angle positions upon inflation thereof and for rendering said platform buoyant, a mooring cable attached to said platform, and anchor means connected to said mooring cable for holding said platform adjacent the sea bottom.

8 Claims, 5 Drawing Figures

Oscar R. Vass
Leslie C. Taylor
Charles A. Lewis
INVENTORS.

BY Thomas O. Watson Jr.
ATTORNEYS.

Oscar R. Vass
Leslie C. Taylor
Charles A. Lewis
INVENTORS

BY N. J. Trousfield
Thomas O. Watson Jr.
ATTORNEYS

Oscar R. Vass
Leslie C. Taylor
Charles A. Lewis
INVENTORS.

BY R. J. Hornfeld
Thomas O. Watson Jr.
ATTORNEYS.

MISSILE LAUNCHING MINE

The invention described herein may be manufactured and used by or for the Government of the United States of America for governmental purposes without the payment of any royalties thereon or therefor.

This invention relates to missile launchers, and more particularly to mine apparatus for launching a plurality of underwater rocket missiles in a predetermined pattern.

Many types of bottom mines have been proposed and used in the past. As the name implies, these mines rest on the sea bottom until such time as their detecting gear senses the presence of a target within range, at which time the mine is exploded to destroy a target. Bottom mines of this type are limited in their utility by the depth of water in the area being mined. That is, bottom mines have maximum depths at which they can be effective without the size of the mine and the quantity of explosive utilized becoming prohibitively large. However, it is frequently desirable to mine areas in which the depth of the water is several times greater than the maximum depths which can now be successfully mined using prior art bottom mines.

It is therefore a primary object of the present invention to provide a new and improved mine which may be used to mine successfully area in which the water depth is several times greater than the maximum depth which could heretofore be mined.

It is another object of this invention to provide an underwater missile launcher or mine which will launch underwater missiles toward the surface of the sea in a predetermined pattern.

It is a further object of the present invention to provide an underwater multiple missile launcher or mine which may be laid by submarines, surface ships or aircraft.

With these and other objects in view, the present invention contemplates an underwater multiple missle launcher which comprises a main case having a pair of launcher bases or platforms connected thereto by means of electrical cables which double as mooring cables. Each platform has a transducer column mounted perpendicular thereto and a plurality of missile launching tubes pivotally mounted on the platform in a circular array around the transducer columns. An underwater rocket missile is disposed in each launching tube and is provided with an appropriate igniter. The free ends of the launching tube are connected to the transducer columns by restraining wires which limit the pivotal movement of the tubes away from the transducer columns. An inflatable flotation bag is secured to each transducer column and provided with associated means for inflating the bags on deployment of the mine and for maintaining the bags inflated sufficient to render the launching platforms buoyant. Upon inflation, the bag pivots the launching tubes away from the transducer columns to the limit of the restraining wires. The lengths of the restraining wires are selected so that the missiles will be launched along divergent paths to define a predetermined configuration at the surface of the sea. A transducer is mounted atop each transducer column and is electrically connected to firing circuitry in the main case for triggering the igniters and launching the missiles upon detection of a target within range of the missiles.

Other objects, advantages and novel features of the present invention will become readily apparent upon consideration of the following detailed description when read in conjunction with the accompanying drawings wherein.

Figure 1:
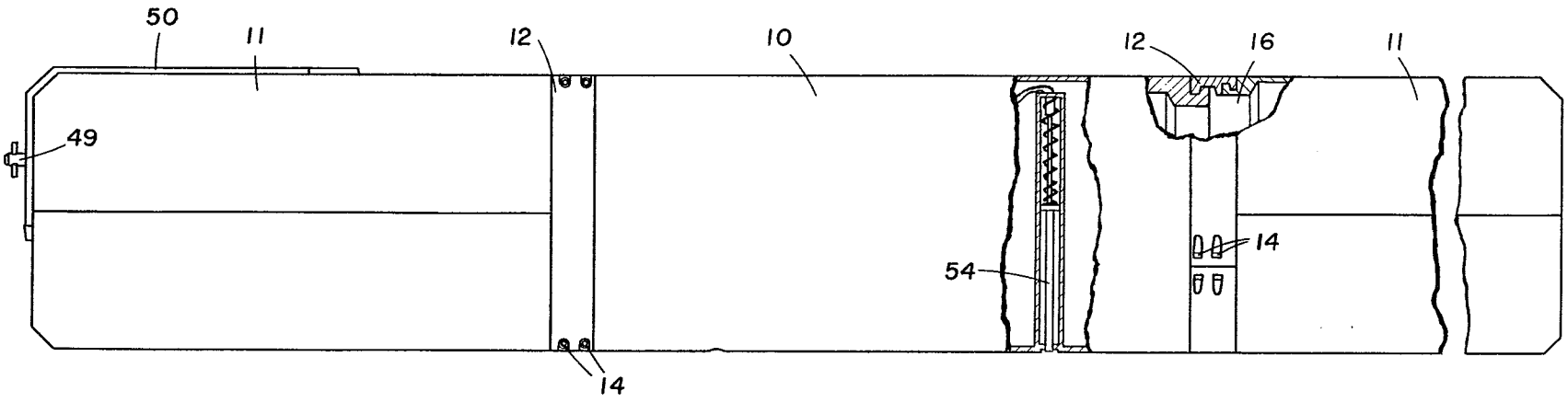
FIG. 1 is an elevation view of the assembled mine.
Figure 2:
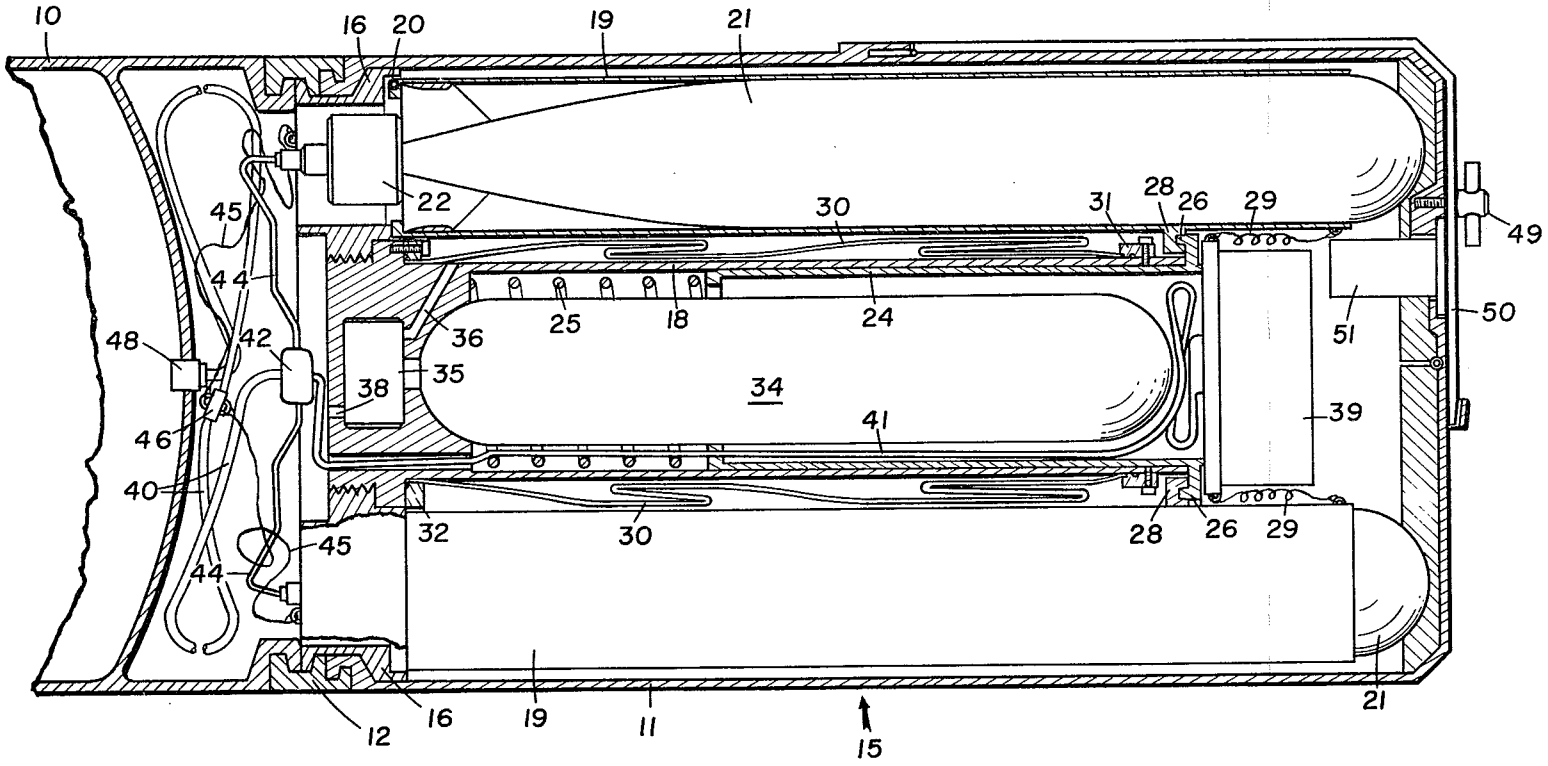
FIG. 2 is an enlarged sectional view of one end of the mine illustrated in FIG. 1.

Attention now is directed to the drawings, wherein like numerals of reference designate like parts throughout the several views, and more particularly to FIGS. 1 and 2 for a detailed description of the invention. The mine comprises a main case 10 having a pair of split launcher covers 11 secured to the ends thereof by means of segmented clamping bands 12. The segments of the clamping bands 12 are coupled together by means of explosive bolts 14 which are fired upon deployment of the mine to permit the split covers 11 to fall away. A multiple missile launcher, designated generally by the reference numeral 15, (FIG. 2) is initially disposed within each launcher cover 11 and comprises a launcher base or platform 16 having a transducer column 18 mounted thereon and perpendicular thereto. The following description will be directed to a single end of the mine since the ends are identical. A plurality of missile launching tubes 19 are spaced in circular array around the transducer column 18 and are pivotally connected to the platform 16 by means of hinges 20. An underwater rocket missile 21 is disposed in each launch tube 19 and is provided with an associated igniter 22 for launching the missile.

A transducer column extender 24 is slidably mounted within the transducer column 18 and is normally urged to the right, as viewed in FIG. 2, by means of a compression spring 25. The extender 24 is provided with lugs 26 which engage mating lugs 28 formed integral with the launching tubes 19 and normally serve to retain the launching tubes parallel to the transducer column 18 in the storage positions shown in FIG. 2. A restraining wire 29 connects the free end of each launching tube 19 to the extender 24 to limit the outward movement of the tubes 19 when pivoting about the axis of the hinges 20.

An inflatable bag 30 is disposed in an initially collapsed configuration about the transducer column 18 and is connectd thereto in sealing relationship by means of sealing rings 31 and 32. A gas bottle 34 is disposed within the transducer column 18 and is connected to a pressure regulator 35 which inflates the bag 30 upon deployment of the launcher 15 by venting gas into the bag through a passageway 36 formed in the base of the column 18. The regulator 35 is adapted to inflate the bag 30 to a pressure slightly greater than the ambient water pressure which is sensed by the regulator 35 through a second passage 38.

An apropriate transducer 39 is mounted on the outer end of the extender 24 and is connected to a main electrical cable 40 by means of a transducer cable 41 and a junction box 42. The igniters 22 are also connected to the main electrical cable 40 by means of igniter cables 44 and the junction box 42. To preclude any strain on the connections in the junction box 42, the platform 16 is coupled directly to the main electrical cable 40 by means of mooring cables 45 and a suitable clamp 46. The length of the mooring cables 45 and the position of the clamp 46 are selected so that, when taut, some slack will remain in the main cable 40 between the clamp 46 and junction box 42. The main electrical cable enters the main case 11 through a watertight clamp 48.

OPERATION

In order that a better understanding of the invention might be had, its mode of operation will now be described. The sequence of events which occur when the mine is launched from a submarine will be described, although, with the exception of the first few steps, the same sequence would occur in a launch from a surface vessel or from an aircraft. The mine is first installed in a torpedo tube and a manual safety screw 49 is removed from the arming bar 50 mounted on the outside of the split covers 11. When the torpedo tube is flooded, a hydrostatic switch (not shown) embodied in the arming switch 51 functions to align the firing train of a pyrotechnic delay column and completes the circuit (not shown) to the arming switch. The mine is then ejected from the torpedo tube and the arming bar 50 separates, permitting the arming switch to close which in turn initiates the pyrotechnic delay column. When the pyrotechnic delay column times out, this closes the main electrical circuit from the power source.

Figure 4:
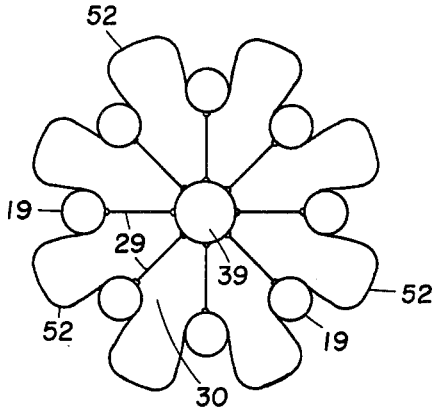
FIG. 4 is a top view of one of the launchers of FIG. 3 and illustrates the lobed configuration of the flotation bag.

Closure of the power circuit causes initiation of the explosive bolts 14 which permits the segments of the clamping bands 12 to fall away. This in turn enables the split halves of the launcher covers 11 to separate and permit the launcher platforms 16 to deploy. The regulators 35 then begin to admit compressed gas from the bottles 34 into the passages 36 to begin inflation of the flotation bags 30. Simultaneously, the compression springs 25 force the transducer column extenders 24 outwardly (to the right as viewed in FIG. 2) to separate the lugs 26 and 28 and to position the transducers 39 beyond the ends of the missiles 21 in the tubes 19. Separation of the lugs 26 and 28 unlocks the launch tubes 19 which then begin to pivot outwardly around the axes of the hinges 20 as the bags 30 continue to inflate. As the bags 30 continue to expand, the launch tubes 19 will continue to pivot outwardly until the restraining wires 29 are taut. As can be best seen in FIG. 4, the cross-section of the bag 30, in a plane parallel to the platform 16, defines a plurality of lobes 52, each of which project between an adjacent pair of launch tubes 19 and serve to accurately position the launch tubes in the desired pattern.

Figure 3:
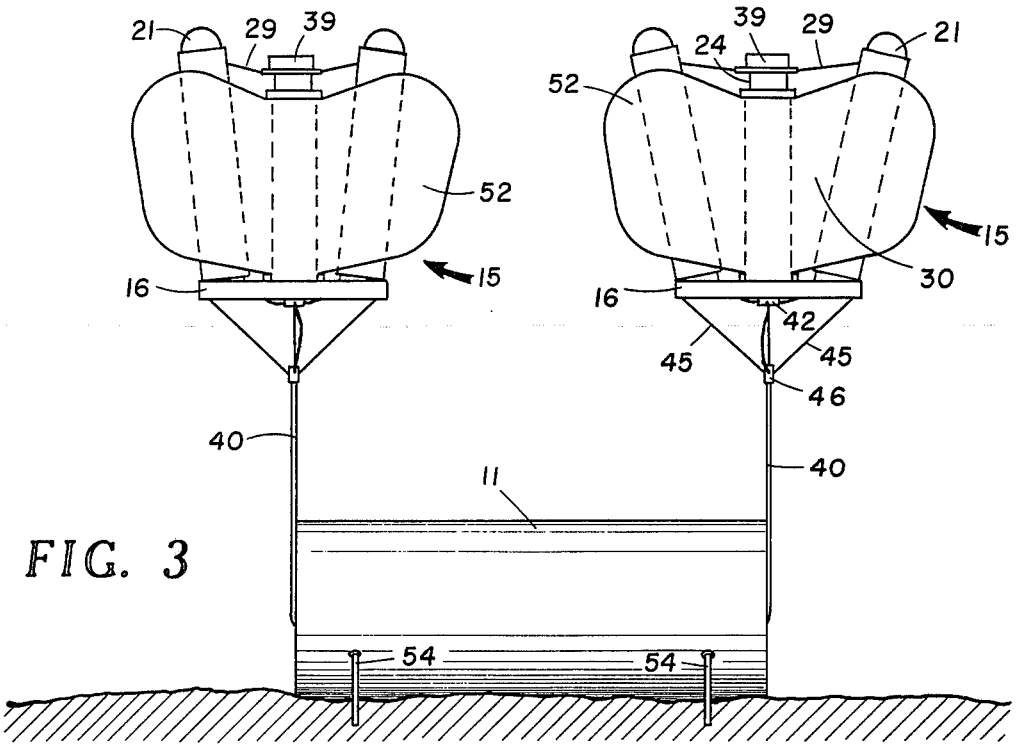
FIG. 3 is a view of the mine on the bottom of the sea with the missile launchers fully deployed.
Figure 5:
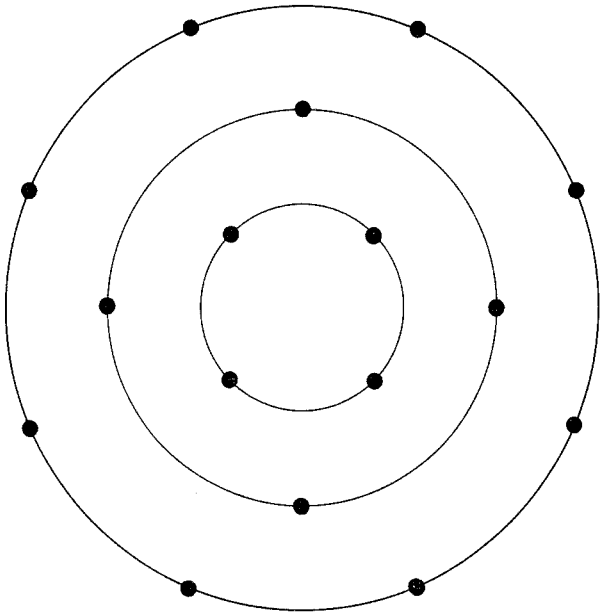
FIG. 5 is an illustration of a typical launch pattern which may be obtained with the launchers of the present invention.

When the mine settles to the bottom of the sea, the missile launchers 15 will be deployed in the fashion shown in FIG. 3. The main case 11 is provided with spring biased anti-roll spikes 54 which engage the sea bottom and preclude movement of the mine case caused by movement of the surrounding water. The mine is then in position to attack any target sensed by the transducer 39. Any of various types of transducers and firing circuits would be suitable for use with the present invention and therefore, no specific transducers or firing circuitry were discussed in detail. When a target is detected by the transducer, the igniters 22 are fired by the firing circuit (not shown) and the missiles are launched from the tubes along divergent paths. By varying the lengths of the restraining wires 29, various missile patterns are readily obtainable. An example of one such pattern is illustrated in FIG. 5. One launcher 15 provides the pattern of the two inner circles and the other launcher 15 provides the pattern of the outer circle. This arragement allows the two launchers to rotate relative to each other without grossly disturbing the overall pattern, as it would if each launcher simply provided a semicircular half of the pattern.

From the foregoing, it will be readily apparent that the present invention provides a mine missile launcher possessing numerous advantages not obtainable with prior art devices. With the present invention it is possible to mine areas where the water depth is several times greater than is possible using present day bottom mines. The pivotal arrangement of the launching tubes permits the use of larger missiles within the fixed diameter of submarine torpedo tubes than would be the case were the tubes to be originally fixed in their canted positions. The inflatable flotation bag not only serves to provide positive buoyancy after the outer case is removed, but also provides a mechanical force to spread the launch tubes and hold them in position against the restraining wires. And finally, the launch angle of each tube can be adjusted at assembly of the launcher to provide various surface hit patterns by using restraining wires of various lengths; thus determining the size and configuration of the launcher's missile spread pattern.

Certain alternatives will immediately suggest themselves to those skilled in the art. For example, a self-foaming plastic could be used to fill the flotation bag which would diminish or eliminate leakage problems in the event of bag damage. Also, the launcher could be made up of a number of pie-shaped segments each containing one missile which would be positioned in the same manner as the launch tubes. The segments could then be made of foam plastic and jacketed with a waterproof material. Thus flotation would be provided by the launcher structure itself and no automatic inflation system would be required. Further, an annular or toroidally-shaped bag which would fit around the transducer column and thus require a seal only at the fill connection thereof could be used instead of the bag with two seals as illustrated in the drawings.

It is to be understood that the above described arrangements are simply illustrative of a preferred embodiment of the present invention. Numerous other modifications may be readily devised by those skilled in the art to achieve a similar apparatus still embodying the principles of the present invention and falling within the spirit and scope thereof.

What is claimed is:

1. An underwater multiple missile launcher comprising:

a platform, a transducer column mounted on said platform and perpendicular thereto, a plurality of missile launching tubes pivotally mounted on said platform in a circular array about said transducer column, each of said launching tubes containing an underwater missile, a restraining wire interconnecting the free end of each launching tube with said transducer column to limit the outward pivotal movement of said launching tubes, flotation means including an initially collapsed inflatable bag secured to said transducer column for rendering said launcher buoyant and for pivoting said launching tubes outward to the limit of said restraining wires upon inflation thereof whereby missiles launched from said tubes will be launched along divergent paths which define a predetermined pattern, the cross-section of said inflatable bag in a plane parallel to said platform defining a plurality of lobes each of which projects between the pair of adjacent tubes upon inflation of said bag for accurately positioning said tubes, a mooring cable attached to said platform, anchor means connected to said mooring cable for holding said platform adjacent the sea bottom, transducer means mounted on said transducer column for detecting and signalling the presence of a target within range of said missiles, and means housed in said anchor means responsive to said transducer means for launching said missiles.

2. An underwater multiple missile launcher comprising a platform, a plurality of missile launching tubes disposed at acute angles to a normal to the surface of said platform whereby missiles launched from said tubes will be launched along divergent paths which define a predetermined pattern, said tubes mounted for limited pivotal movement on said platform for compact storage in parallel positions and for movement to the acute angle positions upon deployment of the launcher, an initially collapsed inflatable bag secured to said platform between said tubes for pivoting said tubes to their acute angle positions upon inflation thereof and for rendering said platform buoyant.

a mooring cable attached to said platform, and anchor means connected to said mooring cable for holding said platform adjacent the sea bottom.

3. A missile launcher as defined in claim 2 wherein a cross-section of said inflatable bag in a plane parallel to said platform defines a plurality of lobes which project between adjacent tubes upon inflation of said bag to accurately position said tubes.

4. An underwater multiple missile launcher mine comprising:

a platform, a plurality of missile launching tubes each containing an underwater missile, said tubes mounted on said platform in a circular array at acute angles to a normal to the surface of said platform whereby missiles launched from said tubes will be launched along divergent paths which define a predetermined pattern, flotation means on said platform for rendering said platform buoyant, a mooring cable attached to said platform, anchor means connected to said mooring cable for holding said platform adjacent the sea bottom, a transducer in said platform for detecting the presense of a target within range of said missiles, and means in said anchor means responsive to said detecting transducer for launching said missiles.

5. A missile launcher as defined in claim 4 wherein said launching tubes are mounted for limited pivotal movement on said platform for compact storage in parallel positions and for movement to the acute angle positions upon deployment of the launcher.

6. A missile launcher as defined in claim 5 wherein restraining wires are connected between said platform and the free ends of said launching tubes to define the outer limit of the pivotal movement of said tubes.

7. A missile launcher as defined in claim 6 wherein said flotation means is an initially collapsed inflatable bag secured to said platform between said tubes for pivoting said tubes to their acute angle positions upon inflation thereof.

8. A missile launcher as defined in claim 7 wherein a cross-section of said inflatable bag in a plane parallel to said platform defines a plurality of lobes which project between adjacent tubes upon inflation of said bag to accurately position said tubes.

* * * * *